US007305101B2

(12) United States Patent
Doudoukjian

(10) Patent No.: US 7,305,101 B2
(45) Date of Patent: Dec. 4, 2007

(54) INSTRUMENT WITH AN INTERFACE FRAME AND A PROCESS FOR PRODUCTION THEREOF

(75) Inventor: George Doudoukjian, Belford, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 428 days.

(21) Appl. No.: 10/345,086

(22) Filed: Jan. 15, 2003

(65) Prior Publication Data

US 2003/0179895 A1 Sep. 25, 2003

Related U.S. Application Data

(60) Provisional application No. 60/365,947, filed on Mar. 20, 2002.

(51) Int. Cl.
*H04R 25/00* (2006.01)

(52) U.S. Cl. ..... 381/322; 381/324; 381/328

(58) Field of Classification Search ..... 381/324, 381/328, 322, 314, 323, 329, 361, 366, 368, 381/312

See application file for complete search history.

(56) References Cited

U.S. PATENT DOCUMENTS 3,598,928 A 8/1971 Hickox ..... 179/107
4,672,672 A 6/1987 Eggert et al. ..... 381/69
4,854,415 A 8/1989 Goschke ..... 181/130
5,201,008 A * 4/1993 Arndt et al. ..... 381/323
5,257,315 A 10/1993 Haertl et al. ..... 381/68.6
5,586,188 A 12/1996 Renggli et al. ..... 381/69.2
5,881,159 A 3/1999 Aceti et al. ..... 381/328
5,889,874 A 3/1999 Schmitt et al. ..... 381/328
5,915,031 A 6/1999 Hanright ..... 381/323
6,816,601 B2 * 11/2004 Lin et al. ..... 381/322

FOREIGN PATENT DOCUMENTS

WO WO 99/60821 5/1999

OTHER PUBLICATIONS

International Search Report, Aug. 4, 2003.

* cited by examiner

*Primary Examiner*—Suhan Ni
(74) *Attorney, Agent, or Firm*—Alexander J. Burke

(57) ABSTRACT

A structure for an instrument or device, such as a hearing aid instrument, having a shell for enclosing the instrument components and an opening through a wall or face of the shell for access to the components wherein the shell has relatively large dimensional tolerances while the components are to be mounted within relatively close dimensional tolerances. A unitary or multi-part interface frame for mounting the components into the shell is mounted to the shell, typically in the opening therein, and has an outer contour adapted to the dimensional and shape tolerances of the shell and an inner contour adapted to the dimensional tolerances of the components.

4 Claims, 3 Drawing Sheets

INSTRUMENT WITH AN INTERFACE FRAME AND A PROCESS FOR PRODUCTION THEREOF

CROSS REFERENCES TO RELATED APPLICATIONS

The present Application is related to and claims benefit of priority from previously filed and now abandoned provisional Patent Application Ser. No. 60/365,947, filed Mar. 20, 2002 by George Doudoukjian for A HEARING AID INSTRUMENT AND ASSOCIATED PROCESS FOR PRODUCTION.

FIELD OF THE INVENTION

The present invention is directed to a structure for a hearing instrument and to method for production of a hearing instrument and, in particular, to a hearing aid that includes a shell molded by a rapid shell manufacturing process, the shell fitting into an ear and having a faceplate with a molded opening therein, and a precisely dimensioned interface frame formed as a full, unitary frame or as a set of rails and having an outer contour adapted to fit into the molded opening and an inner contour adapted to electronic components for mounting of hearing aid electronic components.

BACKGROUND OF THE INVENTION

The majority of present hearing instruments are produced as units fitting entirely within the ear or within the ear canal. These hearing aids commonly referred to as "in-the ear" or "in-the-canal" instruments. Such instruments are typically constructed as a "shell" containing a battery and the electronic components, the shell having a faceplate that typically includes one or more doors or portals providing access to the battery and electronic components.

The hearing aid shell fits substantially within the ear canal so that in use the faceplate is the only visible part of the instrument. The shell is custom molded or shaped to the inner contours of the individual users ear canal to provide a fit that is comfortable and that retains the instrument securely in the ear. The customization of the shell to each individual user requires the precise shaping of the shell to the inner contours of the individual user's ear canal, which requires that each shell be molded or cast with complex contours. In order to reduce costs, the individual shells are typically produced by a "rapid shell manufacturing" process wherein a powder or a liquid material is irradiated with a laser beam into a solid form of a desired shape. The laser beam is directed to irradiate selected small volumes of the powder or liquid to eventually cause the transformation of the entire powder or liquid into the solid in the selected and irradiated volumes and to thereby also define and form the desired shape.

A recurring problem in this and other processes for molding, casting or otherwise forming hearing aid shells, however, is that hearing aid components are relatively small, as are the available space and dimensions within a shell, so that the components must be mounted securely within a shell within very tight dimensions and tolerances. In addition, the components of the hearing aid, such as the microphone, amplifier, sound processing circuitry, sound output transducer and battery, are mounted into the shell through an opening covered by a door. The access door may be separate from or combined with a battery access opening and battery cover, and which thereby presents additional problems with respect to the dimensions of the shell. The problem is compounded in that the component access opening, and perhaps also the battery access opening and their associated doors or portals, often serve as structural elements or components for positioning and mounting the components. For example, in some prior art systems some or all of the electronic components are mounted onto a circuit board, which in turn is mounted into the shell access opening in various ways, such as by adhesives or screws into a lip formed in a rim of the shell access opening, or by mating edges of the opening and the circuit board.

For various reasons, such as inherent inaccuracies in the "rapid shell" forming processes and machines, variations and tolerances in the molding materials, and variations in temperature and humidity during the molding processes, it is difficult to achieve the necessary dimensional accuracies with rapid shell manufacturing processes, or with other processes commonly used to manufacture hearing aid shells. For example, erroneous or poor dimensional control tolerances in a shell may prevent the secure mounting of components within the shell, or may cause the components to interfere with one another. The tolerances may thereby prevent secure support or mounting between the components or between the components and shell or may place undue strains on electrical or mechanical connecting components. In the instance of a circuit board mounted onto a lip around the shell access opening, for example, the lip may be too narrow or the overlap between the edge of the circuit board and the lip insufficient to provide a secure mount, the actual opening of the shell access opening may be too small or too large, and so on. It will also be recognized that these problems and other related problems are compounded yet further when the shell access opening is of a complex shape, which will frequently occur when the components are mounted into the shell access opening as a pre-assembled unit, itself having a complex shape.

SUMMARY OF THE INVENTION

An instrument, such as a hearing instrument for positioning in the ear of a user, and a mounting frame for use within the instrument for mounting an electronic assembly. The instrument has a housing or shell containing an electronic assembly, a faceplate, and a frame for insertion in the faceplate for attachment of the electronic assembly. The frame has an outer contour and an inner contour wherein the outer contour is simpler in detail than the inner contour to adapt the frame to both the dimensional precision with which the shell may be made and the dimensional precision required for mounting the electronic assembly.

BRIEF DESCRIPTION OF THE DRAWINGS

The foregoing and other objects, features and advantages of the present invention will be apparent from the following description of the invention and embodiments thereof, as illustrated in the accompanying figures, wherein.

DETAILED DESCRIPTION OF THE INVENTION

Figure 1:
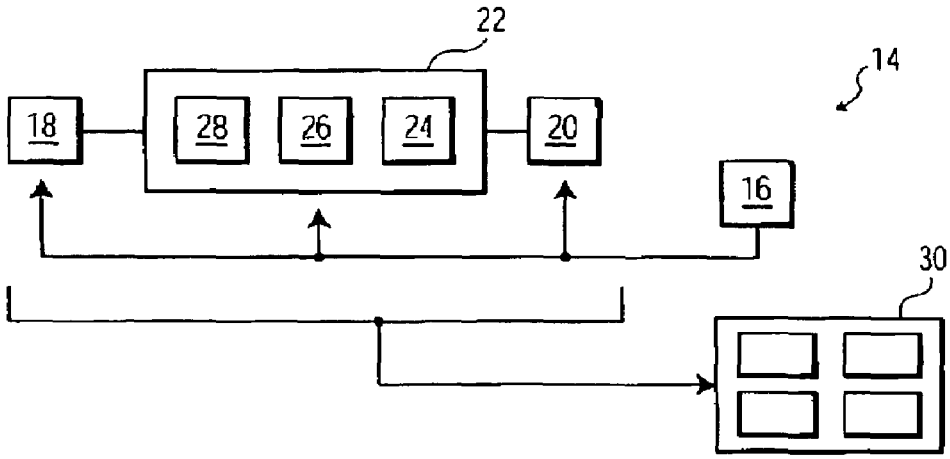
PRIOR ART FIG. 1
FIG. 1 is a block diagram of an exemplary hearing aid device.
Figure 2:
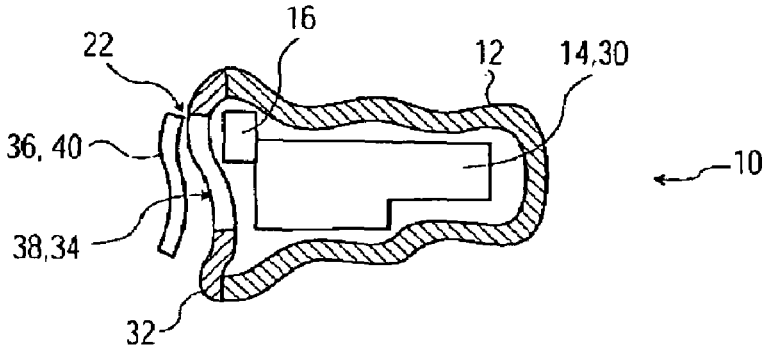
PRIOR ART FIG. 2
FIG. 2 is a diagrammatic cross section of an exemplary hearing aid device.

Referring to FIGS. 1 and 2, therein are shown diagrammatic illustrations of a hearing aid Instrument 10 of the present invention and of the process of assembly of such a hearing aid Instrument 10. As shown therein, a hearing aid Instrument 10, and in particular an "in-the-ear" or "in-the-canal" instrument, includes a Shell 12 fitting into the ear canal and having mounted therein the electronic and electrical Components 14 of the Instrument 10. As indicated, Components 14 may include, for example, a Battery 16, a Microphone 18 for receiving sound input, a Transducer 20 for generating sound output, and Electronic Components 22, which may include, for example, an Amplifier 24 and/or other forms of electronic signal processing components, such as a Digital Signal Processor 26 or Filter 28. Some or all of Components 14 may also be pre-assembled into one or more Component Units 30 by any of a number of methods well known in the arts, such as attachment to one another by adhesives, interlocking parts or mechanisms, or mounting to one or more circuit boards which are then assembled into the Instrument 10, and so on.

As shown in FIG. 2, the casing of an Instrument 10 will typically be comprised of the Shell 12 and a Faceplate 32, which is usually the only visible part of the Instrument 10 when the Instrument 10 is in the user's ear. The Faceplate 32 may be manufactured as a separate part from the Shell 12 and attached thereto or, for example in the rapid shell manufacturing process, as an integral part of the Shell 12.

The Shell 12 or the Faceplate 32 of the Instrument 10 will normally include a Shell Access Opening 34 through which the Components 14 are inserted into the Shell 12. Shell Access Opening 34 is typically closed or covered by a Shell Access Cover 36 which may be, for example, either a plate or a hinged door, and may be mounted into Shell Access Opening 34 by a friction fit, by resilient clips, by adhesives, pins, screws or stakes or any other suitable means for securing Shell Access Cover 36.

The Battery 16 is typically accessible through a Battery Access Opening 38, which may be a part of or separate from Shell Access Opening 34. Battery Access Opening 38 is normally covered by a Battery Door 40, which may be separate from or a part of Shell Access Cover 36. Battery Door 40 may be hinged to Shell Access Cover 36 or to Faceplate 32 or to another part of Shell 12 and, in some instances, Shell Access Cover 36 may be hinged to Battery Door 40. Battery Door 40 typically also includes a holder and contacts for the Battery 16, so that the Battery 16 is swung out of the Shell 12 on the Battery Door 40 when the Battery Door 40 is opened and is thereby more readily accessible.

As discussed previously, Components 14 are relatively small and the space and dimensions within a Shell 12 for mounting Components 14 are relatively small, so that the Components 14 or pre-assembled Components 30 must be mounted within a Shell 12 very precisely and to within relatively tight dimensions and tolerances. As also described, Components 14 or Component Units 30 are typically mounted into the Shell 14 through a Shell Access Opening 34, which may also serve as a structural element or support for positioning and mounting the Components 14 or Component Units 30. For example, and as discussed herein above, a hearing aid of the prior art may provide a mounting lip or shelf surrounding the Shell Access Opening 34 and some or all of the Components 14 may be mounted on a circuit board, the edge of which is attached onto the mounting lip. As described, however, inherent limitations in controlling the dimensions and tolerances of a Shell 12 and Shell Access Opening 34 in the rapid shell manufacturing process and in other shell processes, may hinder the manufacture of a shell with a shell access opening of sufficiently controlled tolerances to allow a secure mount between, for example, the circuit board and the lip of the Shell Access Opening 34 or the Shell 12 itself. Again, this problem is compounded yet further when one or more Components 14 are of complex shapes or when a pre-assembled Component Unit 30 has a complex shape.

Figure 3:
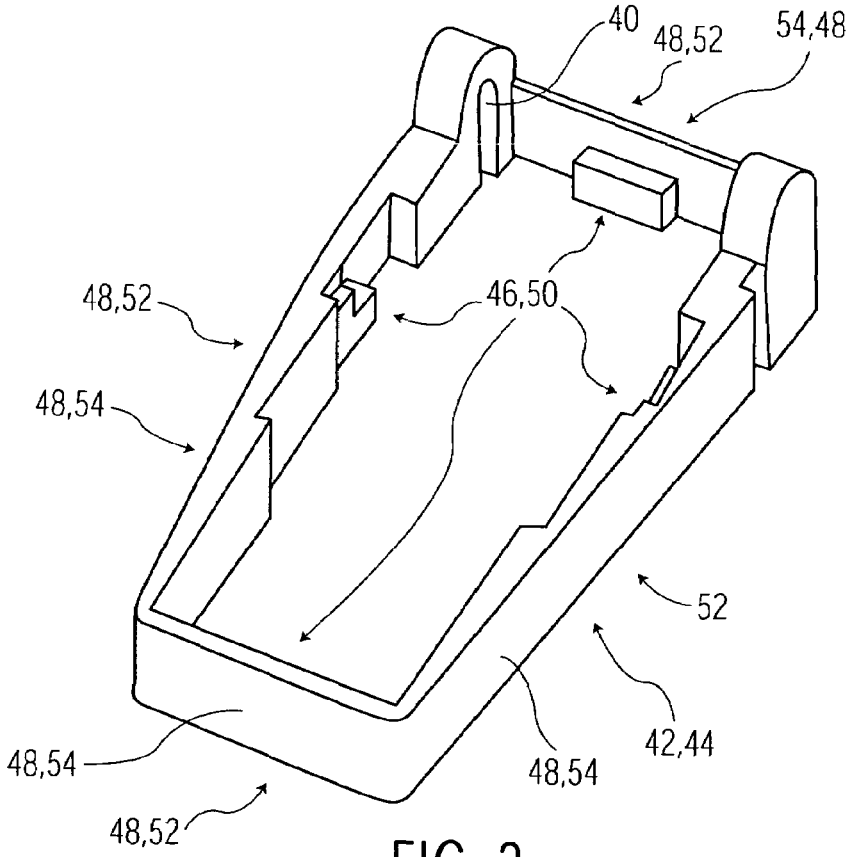
FIGS. 3 and 4 are isometric views of an embodiment of an interface frame of the present invention and a representative assembly of the frame to a hearing aid shell.
Figure 4:
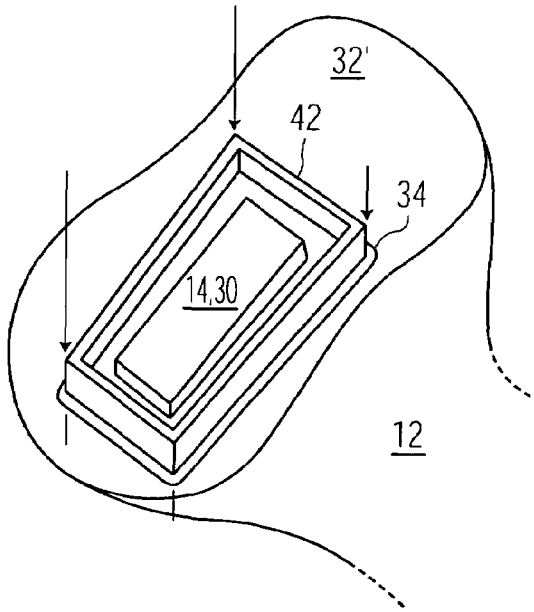

According to the present invention, the conflict between rapid and flexible but imprecise shell manufacturing processes, such as rapid shell manufacturing, and the requirement for precise, secure mounting of hearing aid components may be resolved by use of an Interface Frame 42 as illustrated in FIGS. 3 and 4. As illustrated therein, an Interface Frame 42 is inserted and mounted into a Shell Access Opening 34 of a Shell 12 and provides a structure by which Components 14 or Component Units 30 are mounted into a Shell 12.

In a first embodiment of the present invention, illustrated in FIGS. 3 and 4, an Interface Frame 42, which in this embodiment is a generally rectangular, four sided Mounting Framework 44 having an Inner Contour 46 and an Outer Contour 48. The Inner Contour 46 is formed by the four Interior Surfaces 50 of Framework Sides 52 and is formed to the relatively tight dimensional tolerances and to the shapes and contours necessary to provide precise, secure mounting of one or more Components 14 or one or more Component Units 30, or both. As will be readily recognized, the Components 14 or Components Units 30 may be secured to a Mounting Framework 44 by any of a number of methods well known in the arts, such as by a friction fit or a resilient spring fit, typically wherein the Framework Sides 52 form resilient mounting clips or shapes, or by adhesives, screws, pins, and so on.

The Outer Contour 48 is formed by the four Exterior Surfaces 54 of Framework Sides 52 and may generally be of simpler shape or contour than the Inner Contour 46 formed by Interior Surfaces 50 and need not be produced or formed to the same dimensional tolerances as Inner Contour 46. The principle requirements imposed on Outer Contour 48 and Exterior Surfaces 54 are that Outer Contour 48 and Exterior Surfaces 54 mate with Shell 12 and Shell Access Opening 34 in such a manner as to provide a secure attachment between Mounting Framework 44 and Shell 12 within the method selected for manufacture of Shell 12 and of attaching the Mounting Framework 44 to the Shell 12. For example, the maximum outside dimensions of Outer Contour 48 may be formed smaller than the minimum interior dimensions of Shell Access Opening 34 and provided with a lip, rim or tabs having outside dimensions greater than the maximum inside dimensions of Shell Access Opening 34 so that the lip, rim or tabs always overlap at least some part of Shell 12 around Shell Access Opening 34. The lip, rim or tabs may be attached to Shell 12 by, for example, adhesives, screws, attachment to a lip formed in the rim of the shell access opening, mating edges of the opening and the Components 14 or Component Units 30, friction or interference fits, and so on. It will also be recognized that in certain circumstances a Shell 12 may be formed onto or around an Interface Frame 42, thereby forming the bond, connection or attachment of the Interface Frame 42 to the Shell 12 during the fabrication of the Shell 12. For example, when a Shell 12 is molded, cast or formed by a "rapid shell" process, the Interface Frame 42 may be placed in the mold, casting form or "rapid shell" molding workspace at the appropriate location, so that the Interface Frame 42 will thereby be incorporated into the completed Shell 12 at the desired location.

In summary, Inner Contour 46 formed by Interior Surfaces 50 of Framework Sides 52 are dimensioned and formed to the shapes and more stringent dimensional tolerances required to provide secure mechanical mounting for Components 14 or Component Units 30. Outer Contours 48 are formed by Exterior Surfaces 54 and dimensioned and formed to the shapes and tolerances adequate to provide secure mounting in a Shell Access Opening 34 of a Shell 12. A Mounting Framework 44 thereby meets the dimensional requirements for secure mounting of the Components 14 or Component Units 30 and allows for inequities in the manufacturing tolerances of a Shell 12 manufactured by a rapid shell manufacturing process or by a similar low precision process. It will also be recognized that a Mounting Framework 44 may be manufactured by any of a number of methodologies or processes capable of providing relative small structures or forms to relatively tight dimensional tolerances, at least in those areas, such as Inner Contour 46, where tighter tolerances are necessary. Examples of such would be by metal or plastic injection molding processes or any metal or plastic forming processes capable of achieving the required shapes and dimensional tolerances.

Figure 5:
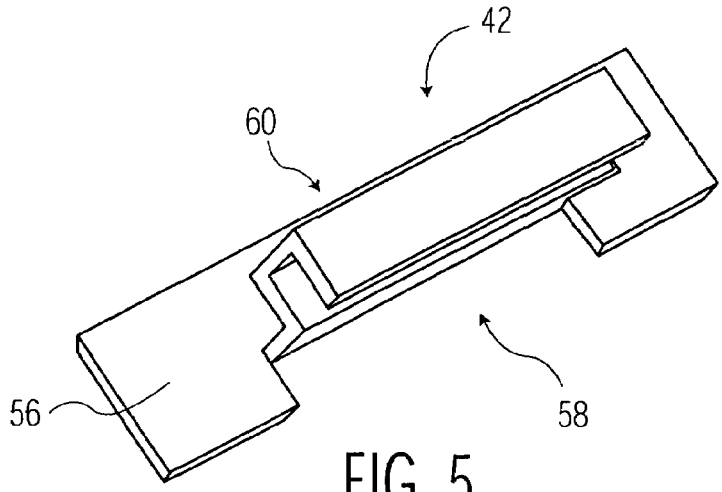
FIG. 5 is an isometric view of an embodiment of an interface rail of the present invention.
Figure 6:
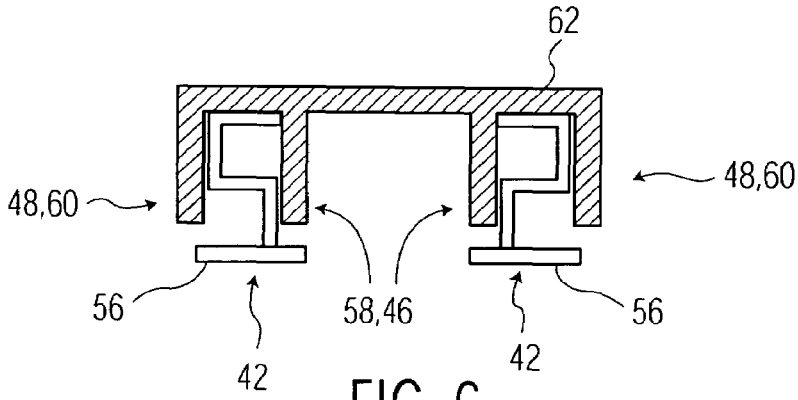
FIG. 6 is a cross sectional view an embodiment of an interface frame of the present invention; and, FIG. 7 is an isometric view of an interface frame and battery door according to the present invention.

An alternate embodiment of an Interface Frame 42 is illustrated in FIGS. 5 and 6, wherein Interface Frame 42 is a multi-part structure wherein the structural parts of the Interface Frame 42 may be directly attached to connected to one another or may be structurally related to form the Interface Frame 42 by attachment to another component, such as the Shell 12. In the embodiment illustrated in FIG. 5, the multi-part Interface Frame 42 is comprised of two or more Insert Rails 56 and the Inner Contour 46 of the Interface Frame 42 is primarily defined by the Interior Rail Surfaces 58 of Insert Rails 56. Again, the Interior Surfaces 58 of Insert Rails 56 and thereby Inner Contour 46 are formed to the relatively tight dimensional tolerances and to the shapes and contours necessary to provide precise, secure mounting of one or more Components 14 or one or more Component Units 30, or both. It will be recognized, in this regard, that those portions of Inner Contour 46 that are not formed of the Interior Rail Surfaces 58 of Insert Rails 56 will be defined, for example, by the inner edge or edges of the Shell Access Opening 34, and that this may result in a difference in the dimensional tolerances of the Inner Contour 46 in these regions. Again, the Components 14 or Components Units 30 may be secured to Interior Rail Surfaces 58 by any of a number of methods well known in the arts, such as by a friction fit or a resilient spring fit, typically wherein the Insert Rails 56 are formed so as to form resilient mounting clips or shapes, adhesives, screws, pins, and so on.

The Outer Contour 48 is similarly defined by Exterior Rail Surfaces 60 of Insert Rails 56 and may again be of simpler shape or contour and than the Inner Contour 46 formed by Interior Rail Surfaces 58, and again need not be held to the same dimensional tolerances. The principle requirements imposed on Outer Contour 48 and Exterior Rail Surfaces 60 are again that Outer Contour 48 and Exterior Rail Surfaces 60 mate with a Shell 12 and a Shell Access Opening 34 in such a manner as to provide a secure attachment between the Insert Rails 56 and the Shell 12 within the method selected for manufacture of Shell 12 and of attaching the Insert Rails 56 to the Shell 12. As previously described, and for example, the maximum outside dimensions of Outer Contour 48 formed by the Rails 56 may be formed smaller than the minimum interior dimensions of Shell Access Opening 34 and each Rail 56 may be provided with a lip, rim, tabs or channel having outside dimensions greater than the maximum inside dimensions of Shell Access Opening 34 so that the lip, rim, tabs or channel always overlap at least some part of Shell 12 around Shell Access Opening 34. The lips, rims, tabs or channels may be attached to Shell 12 by, for example, adhesives, screws, attachment to a lip formed in the rim of the shell access opening, mating edges of the opening and the Components 14 or Component Units 30, friction or interference fits, and so on.

As illustrated in FIG. 5, for example, a resilient material may be selected for part or all of Rails 56 and the Interior Rail Surfaces 58 of the Rails 56 may be formed as resilient clips for holding, for example, a circuit board on which some or all of the Components 14 are mounted. It will be understood that Rails 56 may be attached to the Shell 12 or Faceplate 32 may a variety of methods, including for example adhesives, screws, attachment to a lip formed in the rim of the shell access opening, mating edges of the opening and the Components 14 or Component Units 30, friction or interference fits, and so on.

In this regard, it should be noted that in the embodiment of an Interface Frame 42 as a generally rectangular, four sided Mounting Framework 44 having four Framework Sides 52, the relative positions of Framework Sides 52 with respect to one another and with respect to the Shell Access Opening 34 are fixed by virtue of the Framework Sides 52 being integral parts of a unitary Mounting Framework 44. In the implementation of an Interface Frame 42 as Insert Rails 56, however, the Insert Rails 56 are individual elements and, as such, the relative positions of the Insert Rails 56 with respect to one another and with respect to the Shell Access Opening 34 are not fixed by the elements themselves. As such, the manufacture of the Instrument 10 must provide or include a method for fixing the locations of the Insert Rails 56 with respect to one another and with respect to the Shell 12 and Shell Access Opening 34 when inserting and mounting the Insert Rails 56 into the Shell Access Opening 34. For example, and as illustrated in FIG. 6, when the Shell 12 is manufactured separately from the Interface Frame 42, as in a rapid shell manufacturing method, the Instrument 10 manufacturing process may include a Rail Jig 62 to hold the Insert Rails 56 in a predetermined position with respect to one another when inserting and mounting the Insert Rails 56 into a Shell Access Opening 34, and to manipulate the Insert Rails 56 into a predetermined position with respect to the Shell Access Opening 34. In other Shell 12 manufacturing processes, such as conventional molding processes, the Rail Jig 62 may comprise a part of a mold used to cast or mold the Shell 12, that is, to hold the Insert Rails 56 in a predetermined position with respect to one another and in a predetermined position with respect to the Shell Access Opening 34.

Again, therefore, the Interior Rail Surfaces 58 of Insert Rails 56 are dimensioned and formed, individually and with respect to one another, to the shapes and more stringent dimensional tolerances required to provide secure mechanical mounting for Components 14 or Component Units 30. The Exterior Rail Surfaces 62 are in turn dimensioned and formed to the shapes and tolerances adequate to provide secure mounting in a Shell Access Opening 34 of a Shell 12. An Interface Frame 42 comprised of Insert Rails 56 thereby meets the dimensional requirements for secure mounting of the Components 14 or Component Units 30 and the manufacturing tolerances of a Shell 12 that is manufactured by a rapid shell manufacturing process or similar process. It will be recognized that Insert Rails 56 may be manufactured by any of a number of methodologies or processes capable of providing relative small structures or forms to relatively tight dimensional tolerances. Examples of such would be by metal or plastic injection molding processes, stamping, or any metal or plastic forming processes capable of achieving the required shapes and dimensional tolerances.

Figure 7:
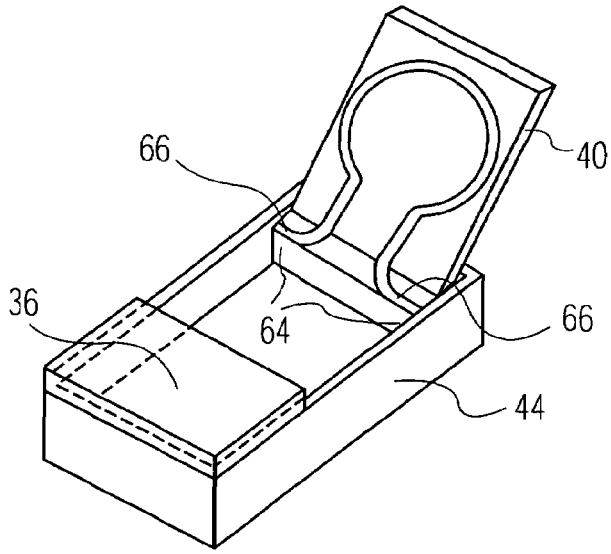

Lastly, an Interface Frame 42, whether comprised of a Mounting Framework 44 or of Insert Rails 56, may be adapted to mount and support either or both of a Battery Door 40 or a Shell Access Door 36. As illustrated in FIG. 7 for an exemplary Mounting Framework 44, one or more of the Framework Sides 52 of the Mounting Framework 44 may be formed as, or have formed therein, Door Sockets 64 for receiving and retaining Hinge Pivots 66 of, for example, a Battery Door 40. In the example shown in FIG. 7, the Battery Door 40 comprised moveable a part of the Faceplate 32 and forms a part of the Shell Access Door 36, which in the present example is a non-hinged panel that may be fixed in place or removable. The Battery Door 40 will typically mount a battery clip of holder for receiving and holding the Battery 16 and circuit connections to the Battery 16. The Door Sockets 64 are formed as grooves in one end of each of opposing Framework Sides 52, and the Hinge Pivots 66 on Battery Door 40 may be formed as separate hinge pins or as a single pin forming both hinges. Hinge Pivots 66 may also be formed of a wire or metal strip shaped to provide the door pivots and to provide both a clip for holding the battery and as one of the connections to the battery connection wire, as illustrated in FIG. 7.

It will be recognized that Door Sockets 64, Hinge Pivots 66 and the details of the design of a Battery Door 40 or Shell Access Cover 36 will be dependent upon the particular design requirements and layout of a given Instrument 10 and the choices made by the designer. It will also be recognized that a Rail 56 may be formed as or have formed therein similarly functioning Door Sockets 64, and so on, and that there are many possible arrangements of Faceplate 32, Shell Access Cover 36 and Battery Door 40, depending on the choice of the designer.

Finally, it will be recognized by those of ordinary skill in the relevant arts that the present invention may be implemented or embodied in a variety of other devices and instruments that through necessity or design combine a shell or mounting having dimensional tolerances that conflict with the dimensional tolerances required to mate the shell or mounting with other components. Such devices may include, for example, a wide range of medical or scientific devices or instruments, such as devices having or requiring individually tailored or fitted shells, mountings or other components, devices intended for one time use, devices requiring minimum shell or casing costs, and devices having disposable or destructible housings or shells containing, for example, reusable, complex or expensive components, and so on. In general, the present invention may be implemented in any situation in which it is necessary to mate or otherwise mutually adapt or fit two or more components or parts having different dimensional tolerances or requirements.

Since certain changes may be made in the above described invention without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A hearing instrument for insertion into an ear canal of a user, comprising:

a shell for enclosing hearing instrument components and comprising an integrated faceplate, the faceplate facing generally outwardly from the ear canal and comprising an opening; and an interface frame that mates with the integrated faceplate, the interface frame comprising an outer contour, the dimensions of the outer contour conforming to the dimensions of the opening in the faceplate; and an inner contour of predetermined, fixed dimensions, where the hearing instrument components are secured to the inner contour.

2. A hearing instrument as set forth in claim 1, where the components comprise at least one component unit.

3. A hearing instrument as set forth in claim 1, where the interface frame comprises a plurality of rails.

4. A hearing instrument as set forth in claim 1, where the interface frame further comprises a door.

* * * * *